United States Patent [19]

Ogiri et al.

[11] Patent Number: 5,040,779

[45] Date of Patent: Aug. 20, 1991

[54] DETACHABLE PAPER DELIVERY ROLLER FOR A PAPER UTILIZING DEVICE

[75] Inventors: Tadakazu Ogiri, Takatsuki; Hiroshi Kubota, Osaka; Masami Fuchi, Neyagawa; Junya Sasabe, Kobe; Masao Sugimori, Hirakata, all of Japan

[73] Assignee: Mita Industrial Co., Ltd., Osaka, Japan

[21] Appl. No.: 368,839

[22] Filed: Jun. 20, 1989

[30] Foreign Application Priority Data

Jun. 23, 1988 [JP] Japan ..... 63-155711
Nov. 11, 1988 [JP] Japan ..... 63-286310

[51] Int. Cl.[5] ..... B65H 3/06

[52] U.S. Cl. ..... 271/109; 198/789; 384/906; 403/26; 403/301; 403/306

[58] Field of Search ..... 271/109, 117, 314; 198/789; 226/190, 194; 464/901, 120; 384/906; 277/136; 403/26, 301, 302, 306, 11

[56] References Cited

U.S. PATENT DOCUMENTS

| | | | |
|---|---|---|---|
| 2,204,715 | 6/1940 | Wimmer . | |
| 2,624,445 | 1/1953 | Wallman | 198/789 X |
| 3,592,462 | 7/1971 | Fackler . | |
| 3,608,876 | 9/1971 | Leaich | 198/789 X |
| 3,867,748 | 2/1975 | Miller | 198/789 X |
| 4,063,636 | 12/1977 | Vom Stein | 198/789 X |
| 4,167,997 | 9/1979 | Revells | 198/789 |
| 4,871,277 | 10/1989 | Fuchigami | 464/901 X |

FOREIGN PATENT DOCUMENTS

| | | | |
|---|---|---|---|
| 0125538 | 7/1983 | Japan | 271/109 |
| 186841 | 10/1984 | Japan | 271/10 |
| 0086330 | 5/1986 | Japan | 271/109 |
| 086330 | 9/1986 | Japan . | |
| 480245 | 12/1969 | Switzerland | 198/789 |
| 461933 | 2/1937 | United Kingdom | 198/789 |

OTHER PUBLICATIONS

Japanese Patent Publication No. 61-178334 And English Translation Of Lines 7-16 From Left Column On Page 2.

Japanese Utility Model Publication No. 61-52646 And English Translation Of Lines 10-19 On Page 6.

*Primary Examiner*—Robert P. Olszewski
*Assistant Examiner*—Boris Milef
*Attorney, Agent, or Firm*—Antonelli, Terry, Stout & Kraus

[57] ABSTRACT

A paper delivery apparatus for delivering paper to a predetermined place by driving a roller support shaft with a the paper coming in contact with roller attached to the roller support shaft. The roller support shaft and the drive shaft are connected to each other between a pair of lateral plates. Bearings are attached to the roller support shaft at both ends thereof and are axially movably supported by bearing support members. The roller support shaft together with the bearings may be readily removed from the bearing support members by moving the roller support shaft or the bearings in the axial direction.

19 Claims, 11 Drawing Sheets

DETACHABLE PAPER DELIVERY ROLLER FOR A PAPER UTILIZING DEVICE

BACKGROUND OF THE INVENTION

The present invention relates to a paper delivery apparatus using a roller, for use in (i) an image forming apparatus such as an electrophotographic copying apparatus, facsimile, printer, (ii) a paper feeding apparatus connected to such an image forming apparatus, or (iii) the like.

There is known a paper delivery apparatus of the type above-mentioned in which paper sheets housed in a paper feed cassette or stacked on a paper stack stand, are fed one by one to a paper delivery passage by driving a roller support shaft, with the paper sheets coming in contact with the rollers secured to the roller support shaft.

In such a paper delivery apparatus, the roller support shaft is rotatably supported by bearings respectively attached to a pair of lateral plates. Snap rings fitted on the roller support shaft prevent the bearings and the roller support shaft from being axially relatively moved. The roller support shaft has one end which passes through one lateral plate and to which a driving gear is attached. To replace the rollers as they are worn away in this paper delivery apparatus, it is necessary to remove and reattach the driving gear and the snap rings from and to the roller support shaft. Accordingly, such replacement is very troublesome.

In view of the foregoing, there has been proposed a paper delivery apparatus in which the roller support shaft is composed of three shaft members connected to each other directly or through joints, and rollers are attached to the center shaft member, while both side shaft members are attached to the lateral plates through bearings to support the center shaft member, and a driving gear is attached to either one of the side shaft members (Japanese Utility Model Unexamined Publication No. 41040/88). According to this paper delivery apparatus, when the center shaft member is disconnected from the side shaft members by moving axially either one of the side shaft members, or when the shaft members are disconnected from the joints, the rollers may be replaced together with the center shaft member. In this paper delivery apparatus, it is therefore not necessary to remove the driving gear at the time of replacement of the rollers.

In the apparatus having the shaft members directly connected to each other, the snap rings fitted on the roller support shaft, with the bearings sandwiched thereby, prevent the side shaft members and the bearings from being relatively moved in the axial direction. Accordingly, at the time of replacement of the rollers, the snap rings need to be removed from or attached to the roller support shaft with the use of tools. In the apparatus having the shaft members connected through the joints, the joints and the shaft members are secured with screws. It is therefore required to loosen and fasten these screws with a screwdriver. Further, such operations need to be made in a limited space between the lateral plates. Thus, the working efficiency of roller replacement cannot be sufficiently improved.

Also, there has been proposed a paper delivery apparatus in which the roller support shaft is removed from the lateral plates without the use of tools (Japanese Patent Unexamined Publication No. 186841/84). In this paper delivery apparatus, the roller support shaft has one end attached to the lateral plate through a bearing, and the other end fitted on a drive shaft. The lateral plate is held by and between the snap ring fitted to one end of the roller support shaft, and the bearing is biased toward the snap ring by a coil spring. This arrangement prevents the roller support shaft from being axially moved.

According to this paper delivery apparatus, the roller support shaft may be axially moved against the spring-load of the coil spring. This enables the one end of the roller support shaft to be pulled out from the drive shaft. Thereafter, the one end of the roller support shaft may be pivoted upward so that the other end together with the bearing is removed from the lateral plate concerned. In this paper delivery apparatus, however, the one end of the roller support shaft is supported by the drive shaft. Accordingly, to prevent the roller support shaft from being eccentrically rotated, it is required to fit the roller support shaft and the drive shaft to each other with high precision. Such highly precise fitting is very difficult, particularly, in a limited space in an image forming apparatus.

OBJECT AND SUMMARY OF THE INVENTION

It is an object of the present invention to provide a paper delivery apparatus using a roller in which the roller support shaft may be readily attached and removed.

The object above-mentioned may be achieved by providing a paper delivery apparatus using a roller as set forth below.

The paper delivery apparatus comprises:

a drive shaft of which at least the tip is disposed between a pair of lateral plates;

a roller support shaft having a roller attached thereto;

bearings fitted on the roller support shaft at both ends thereof;

bearing support members for axially movably supporting the bearings such that the bearings may be removed therefrom when moved toward the drive shaft; and a joint axially movably attached to the drive shaft, the joint being adapted to engage with the roller support shaft and to prevent the bearings from coming off the bearing support members, with the joint moved toward the roller support shaft.

According to the paper delivery apparatus having the arrangement above-mentioned, the roller support shaft may be supported by the bearing support members through the bearings. With the joint moved toward the roller support shaft, the drive shaft and the roller support shaft may be integrally rotatably connected to each other by the joint. Further, the joint prevents the bearings coming off from the bearing support members.

The roller support shaft above-mentioned is supported at a predetermined position by the bearing support members. This eliminates the need to connect, with high precision, the roller support shaft and the drive shaft to each other, as would be required in the arrangement in which the roller support shaft is supported at one end thereof by the drive shaft. That is, even though the roller support shaft and the drive shaft are axially shifted, the joint and the roller support shaft may be loosely engaged with each other, thereby to prevent the roller support shaft from being eccentrically rotated.

According to the paper delivery apparatus above-mentioned, the bearings may be axially movable simultaneously with the movement of the joint to disconnect the drive shaft from the roller support shaft. Accordingly, the roller support shaft together with the bearings may be removed from the bearing support members by moving, toward the drive shaft, the bearings independently or together with the roller support shaft.

The bearings may be fitted, as prevented from being axially moved, on the roller support shaft. In this case, the roller support shaft together with the bearings may be removed from the bearing support members by merely releasing the connection of the drive shaft to the roller support shaft through the joint and moving the roller support shaft, first, toward the drive shaft by a predetermined distance and, then, in a radial direction.

The object above-mentioned may also be achieved by providing a paper delivery apparatus using a roller set forth below.

The paper delivery apparatus using a roller comprises:

a drive shaft, of which at least the tip is disposed between a pair of lateral plates;

a roller support shaft having a roller attached thereto and disposed in series to the drive shaft;

bearings fitted on the roller support shaft at both ends thereof;

bearing support members for axially movably supporting the bearings such that the bearings may be removed from the bearing support members when moved in a direction away from the drive shaft;

an engagement portion arranged such that the roller support shaft and the drive shaft are integrally rotatably engaged with each other when the roller support shaft, together with the bearings, is moved toward the drive shaft; and an engagement maintaining member for maintaining the engagement of the drive shaft with the roller support shaft.

According to the paper delivery apparatus using a roller having the arrangement above-mentioned, the roller support shaft may be supported by the bearing support members through the bearings. With the roller support shaft together with the bearings moved toward the drive shaft, the roller support shaft and the drive shaft may be integrally rotatably engaged with each other by the engagement portion. Further, the engagement of the drive shaft with the roller support shaft may be maintained by the engagement maintaining member.

In this paper delivery apparatus too, the roller support shaft is supported at a predetermined position by the bearing support members. This eliminates the need to connect, with high precision, the drive shaft to the roller support shaft. Thus, the connection of both shafts may be facilitated.

According to the paper delivery apparatus above-mentioned, the roller support shaft may be disengaged from the drive shaft by moving the roller support shaft in a direction away from the drive shaft. Then, the roller support shaft together with the bearings may be removed from the bearing support members.

The bearings are fitted, as prevented from being axially moved, on the roller support shaft. The bearing support members are preferably arranged such that the bearings may be removed therefrom by moving the bearings first in a direction away from the drive shaft and then in a radial direction of the roller support shaft. In this case, the roller support shaft together with the bearings may be removed from the bearing support members by merely moving the roller support shaft first in a direction away from the drive shaft and then in the diametrical direction of the roller support shaft.

The features of the present invention will be apparent from the following description made with reference to the attached drawings.

DETAILED DESCRIPTION OF THE PREFERRED EMBODIMENTS

The following description will discuss in detail the present invention with reference to the attached drawings showing preferred embodiments thereof.

Figure 7:
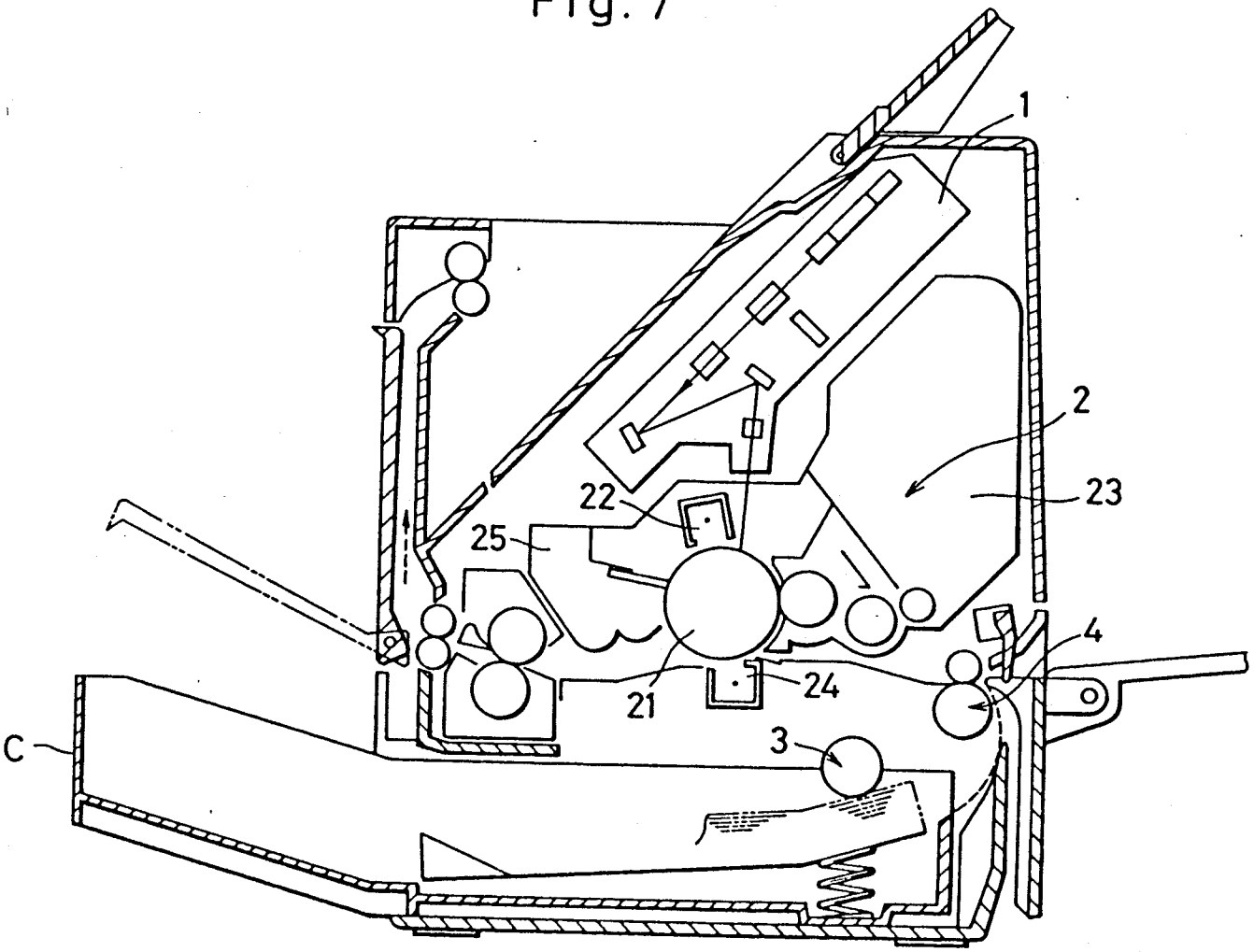
FIG. 7 is a schematic view of the inner arrangement of an image forming apparatus to which the paper delivery apparatus of the present invention is applied.

FIG. 7 is a schematic view of the inner arrangement of a laser beam printer incorporating the paper delivery apparatus of the present invention.

The laser beam printer includes an optical system 1 for oscillating a laser beam according to an image signal, a process unit 2 for printing data on paper, a paper delivery apparatus 3 of the present invention for taking out paper sheets, one by one, from paper feeding casette C, and a conveying device 4 for conveying the paper delivered from the paper delivery apparatus 3, to a predetermined place.

The process unit 2 includes a photoreceptor drum 21 which is exposed to a laser beam oscillated by the optical system 1 and on which an electrostatic latent image is formed. The process unit 2 further includes, around the photoreceptor drum 21, a corona discharger 22, a developing device 23, a transferring corona discharger 24 and a cleaning device 25.

Figures 1, 2:
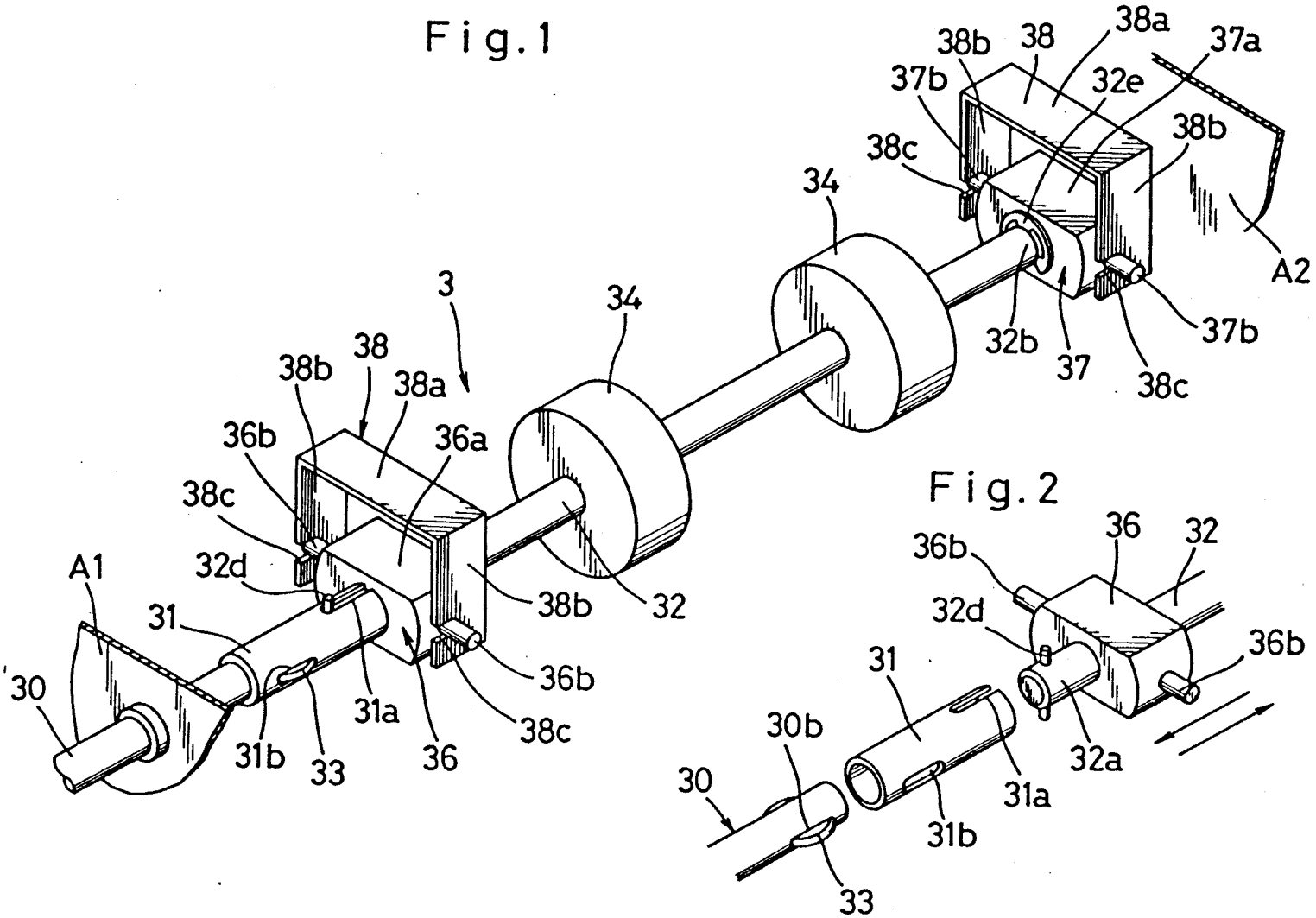
FIG. 1 is a perspective view of a paper delivery apparatus using a roller in accordance with a first embodiment of the present invention.
FIG. 2 is an exploded perspective view of main portions of the apparatus in FIG. 1.

As shown in FIGS. 1 and 2, the paper delivery apparatus 3 has a main portion including: a drive shaft 30; a casing joint 31 axially movably fitted on the drive shaft 30; a roller support shaft 32 disposed with one end thereof 32*a* located in the vicinity of the tip of the drive shaft 30; rubber rollers 34 integrally rotatably fitted, and prevented from being axially moved, on the roller support shaft 32; bearings 36, 37 respectively fitted to both ends 32*a*, 32*b* of the roller support shaft 32; and bearing support members 38 for supporting the bearings 36, 37.

The drive shaft 30, adapted to rotate the roller support shaft 32 through the joint 31, is driven by a drive system (not shown) of the laser beam printer. The drive shaft 30, joint 31, and roller support shaft 32 are disposed between a pair of lateral plates A1, A2 inside of the laser beam printer with a predetermined distance provided therebetween. The drive shaft 30 passes through one lateral plate A1 and is rotatably supported thereby.

The drive shaft 30 is provided at the tip thereof with a hollow portion 30*a* (See FIG. 5) in which a snap pin 33 of the type having two legs is disposed. The snap pin 33 is provided at the leg portions thereof with arcuate expanded portions 33*a* which outwardly project. These expanded portions 33*a* project from the drive shaft 30 through communication holes 30*b* communicating with the hollow portion 30*a*. Those parts of the expanded portions 33*a* which project from the drive shaft 30 are engaged with engagement holes 31*b* in the joint 31. This prevents the joint 31 from being axially moved.

The bearings 36, 37 are relatively rotatably fitted on the roller support shaft 32. The bearing 36 adjacent one end 32*a*, is axially movably fitted to the roller support shaft 32 such that the bearing 36 may be independently removed form the associated bearing support member 38. Snap rings 32*e* are fitted, sandwiching the other bearing 37, on the roller support shaft 32. This prevents the other bearing 37 from being axially moved. The bearings 36, 37 are composed of (i) main bodies 36*a*, 37*a* substantially in the form of a rectangular parallelpiped, into which the roller support shaft 32 may be introduced, and (ii) pins 36*b*, 37*b* horizontally projecting from both lateral sides of the main bodies 36*a*, 37*a*.

The roller support shaft 32 is provided at the one end 32*a* thereof with an engagement pin 32*d* which is loosely engaged with engagement grooves 31*a* in the joint 31 to be discussed later. This engagement pin 32*d* is formed by pressingly inserting a spring pin into, for example, a through-hole diametically formed in the roller support shaft 32.

Figure 3:
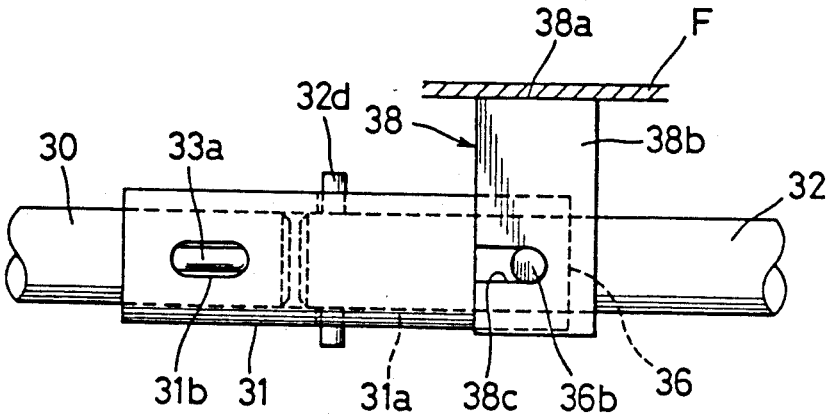
FIG. 3 is a front view of main portions of the apparatus in FIG. 1, illustrating how a roller support shaft is connected to a drive shaft.

Each of the bearing support members 38 is formed by bending a metallic sheet into a two-leg shape. The top surfaces 38*a* of the bearing support members 38 are secured to a frame F or the like inside of the laser beam printer (See FIG. 3). Each of the leg portions 38*b* of the bearing support members 38 has an axially extending slit 38*c* opened in the direction toward the drive shaft 30. The pins 36*b*, 37*b* are engaged with the slits 38*c* so that the bearings 36, 37 are supported by the bearing support members 38.

With the joint 31 secured to the drive shaft 30 by the snap pin 33, the tip of the joint 31 comes in contact with the bearing 36. Accordingly, the joint 31 prevents the bearing 36 from being moved toward the drive shaft 30. The joint 31 may be fitted to the one end 32*a* of the roller support shaft 32. To facilitate such fitting, there is formed a relatively large clearance between the joint 31 and the roller support shaft 32. The joint 31 is provided in the tip thereof with engagement grooves 31*a* with which the engagement pin 32*d*, attached to the roller support shaft 32, is engaged. The engagement grooves 31*a* are opened at one ends thereof such that the engagement pin 32*d* is inserted into the grooves 31*a*. The engagement grooves 31*a* have such a length that the engagement pin 32*d* comes in contact with the innermost ends of the engagement grooves 31*a*. This prevents the roller support shaft 32 from being moved toward the drive shaft 30.

The following description will discuss how to remove the roller support shaft 32.

Figure 4A:
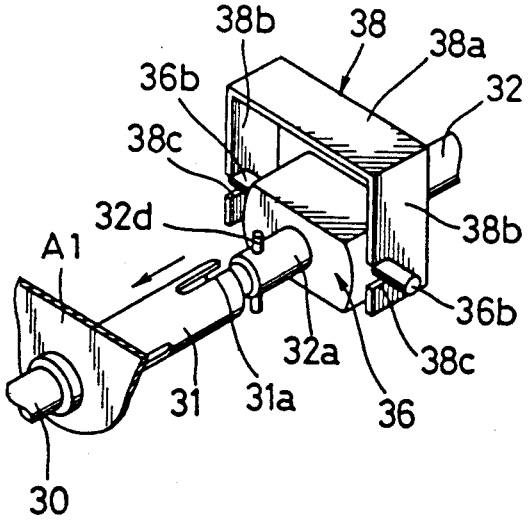
FIG. 4 (A) and (B) are perspective views of main portions of the apparatus in FIG. 1, illustrating how to remove the roller support shaft.
Figure 4B:
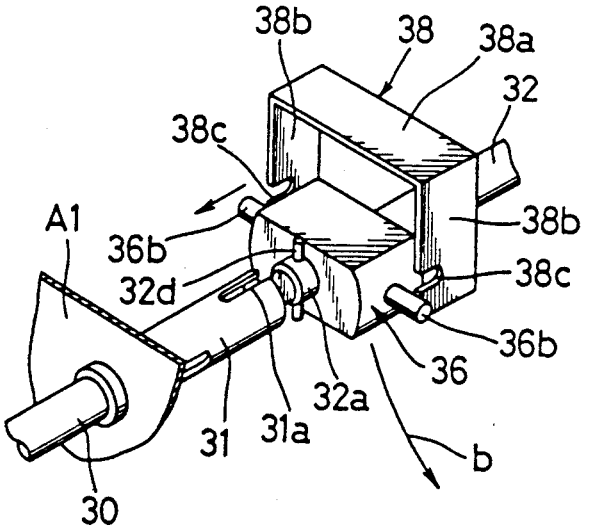
Figure 5:
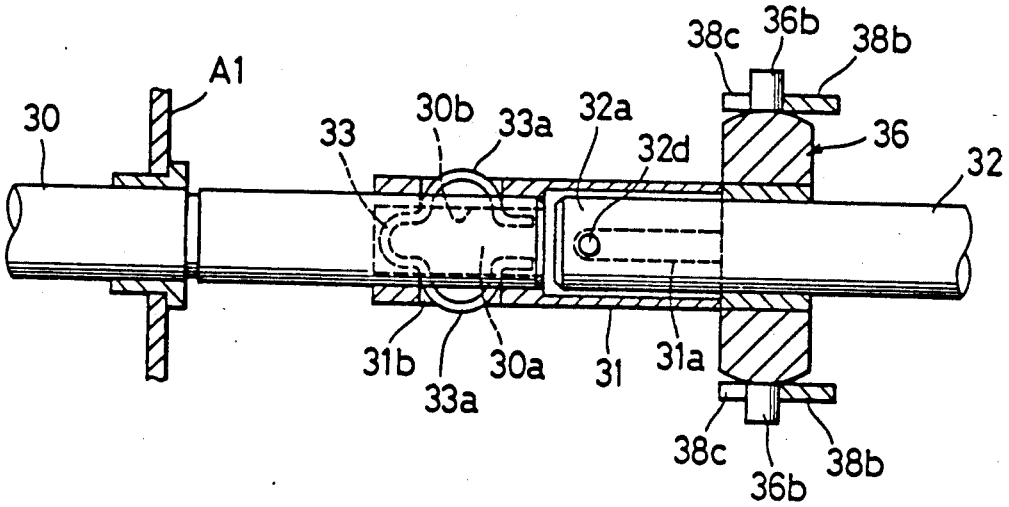
FIG. 5 is a fragmentary sectional view illustrating the connection of the roller support shaft to the drive shaft.
Figure 6:
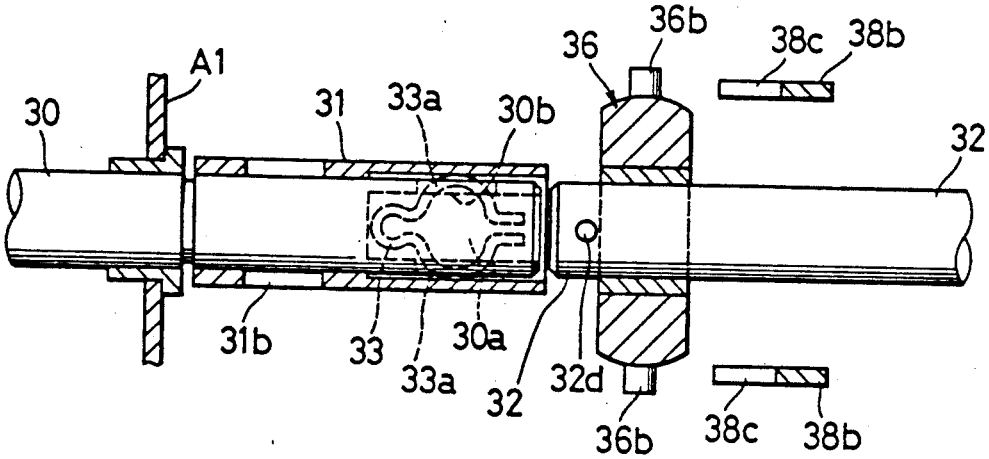
FIG. 6 is a fragmentary sectional view of the roller support shaft and the drive shaft as disconnected from each other.

As shown in FIGS. 1 and 5, when the roller support shaft 32 is connected to the drive shaft 30 through the joint 31, the joint 31 is first moved toward the lateral plate A1 to disengage the engagement pin 32*d* from the engagement grooves 31*a*. This causes the tip of the joint 31 to be separated from the bearing 36, enabling the bearing 36 to be axially moved. At this time, the expanded portions 33*a* of the snap pin 33 are pushed in toward the inside of the joint 31 by the edges of the engagement holes 31*b* thereof (See FIG. 4A and FIG. 6). Then, the bearing 36 is moved toward the drive shaft 30 and removed from the bearing support member 38 concerned (See FIG. 4B and FIG. 6). At this time, the bearing 36 is independently moved toward the drive shaft 30, since the bearing 36 is axially movably fitted to the roller support shaft 32. To enable the roller support shaft 32 to be moved toward the lateral plate A1, the one end 32*a* of the roller support shaft 32 is moved downward (in the direction shown by an arrow b in FIG. 4 B). thereafter, when the roller support shaft 32 is pulled toward the lateral plate A1, the bearing 37 at the other end 32*b* of the roller support shaft 32 is removed from the adjacent bearing support member 38. Thus, the roller support shaft 32 may be taken out.

The roller support shaft 32 may be attached by reversing the procedure above-mentioned. More specifically, the roller support shaft 32 is maintained together with the bearing 36 with both lateral sides of the bearing 36 held from the underside thereof by the fingers. The pin 37*b* of the bearing 37 is then engaged with the slits 38*c* in its bearing support member 38. Then, the bearing 36 is engaged with the slits 38*c* of the other bearing support member 38. The joint 31 positioned toward the lateral plate A1, is then moved toward the roller support shaft 32 so that the roller support shaft 32 and the drive shaft 30 are connected to each other through the joint 31. At this time, the expanded portions 33*a* of the snap pin 33 are resiliently fitted in the engagement holes 31*b* of the joint 31. This causes the joint 31 to be secured at a predetermined position. Simultaneously, the tip of the joint 31 comes in contact with the associated bearing 36 supported by the bearing support member 38. This prevents the bearing 36 from being axially moved. Further, the engagement pin 32*d* of the roller support shaft 32 strikes against the innermost parts of the engagement grooves 31*a* in the joint 31. This prevents the roller support shaft 32 from being moved toward the drive shaft 30.

As thus described, according to the paper delivery apparatus 3 above-mentioned, the roller support shaft 32 may be readily attached and removed without use of tools. Further, the roller support shaft 32 is supported by the bearing support members 38 disposed between the lateral plates A1, A2 of the laser beam printer. Accordingly, the roller support shaft 32 may be shorter in length, as compared with the apparatus in which the roller support shaft is disposed between the lateral plates A1, A2. This further facilitates the attachment and removel of the roller support shaft 32.

In the apparatus above-mentioned, the roller support shaft is not directly supported by the drive shaft. It is therefore not required to carry out, with high precision, the connection of the drive shaft 30 to the roller support shaft 32 through the joint 31. This facilitates the connection of the roller support shaft 32 to the drive shaft 30.

Figure 8:
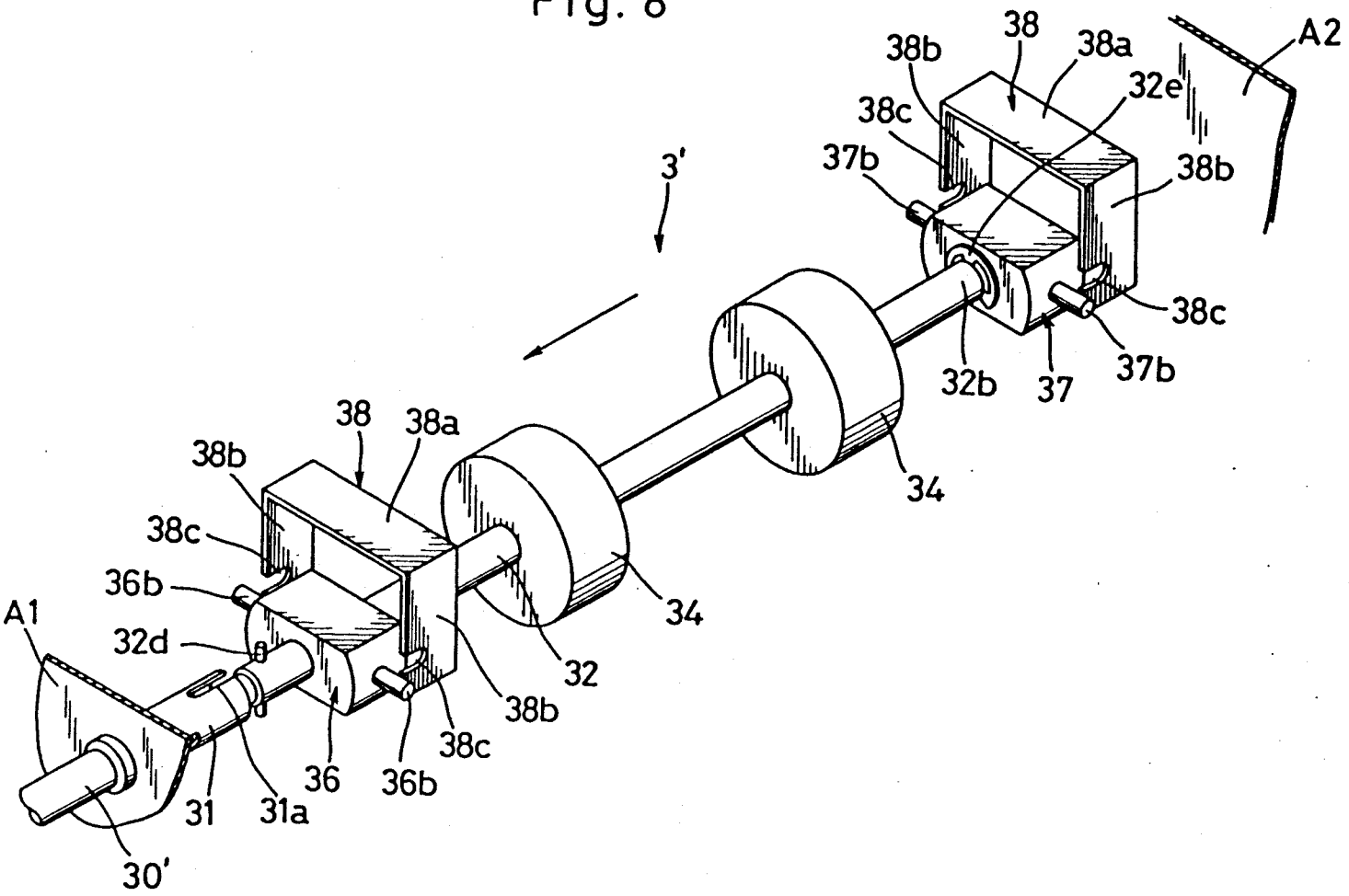
FIG. 8 is a perspective view of the paper delivery apparatus in accordance with a second embodiment of the present invention.
Figure 9:
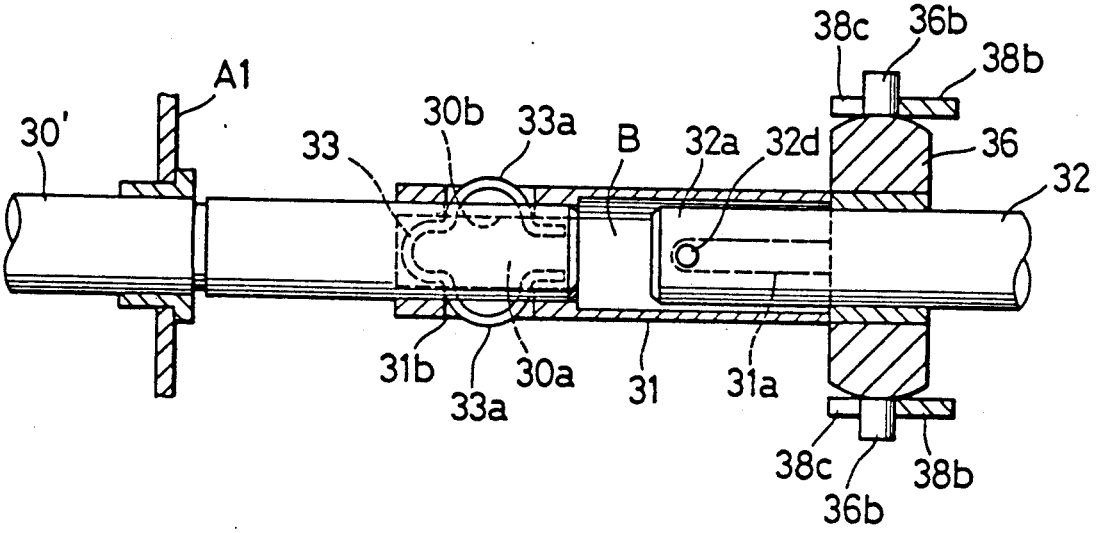
FIG. 9 is a section view of the roller support shaft and the drive shaft as connected to each other in the apparatus in FIG. 8.

FIGS. 8 and 9 show a second embodiment of the present invention.

A paper delivery apparatus 3' in FIGS. 8 and 9 is different from the paper delivery apparatus 3 of the first embodiment, in the following points.

In the second embodiment, bearings 36 and 37 are attached, so as to be prevented from being axially moved, to a roller support shaft 31. A wide space B exists between the end of the roller support shaft 32 and a drive shaft 30' such that the roller support shaft 32 is movable toward the lateral plate A1, by a predetermined distance. Space B is adjacent a position where the roller support shaft 32 is supported by bearing support members 38 (See FIG. 9). The minimum distance of the space B between the roller support shaft 32 and the drive shaft 30 is in a range such that pins 36*b*, 37*b* of the bearings 36, 37 may be removed from slits 38*c* in the bearing support members 38 by the axial movement of the roller support shaft 32.

According to this second embodiment, the bearings 36, 37 may be removed from the bearing support members 38 by merely moving the joint 31 toward the lateral plate A1 to move the roller support shaft 32 toward the drive shaft 30, as shown in FIG. 8. The bearings 36, 37 may be attached to the bearing support members 38 by reversing the procedure above-mentioned. Thus, the removal and attachment of the roller support shaft 32 may be further facilitated. In the second embodiment, the bearing 36 and the roller support shaft 32 are prevented from being axially relatively moved. It is therefore sufficient to arrange that the joint 31 prevents at least one of the roller support shaft 32 and the bearing 36 from being axially moved.

The following description will discuss paper delivery apparatus 5 and 7 in accordance with third and fourth embodiments of the present invention, with reference to FIGS. 10 to 15.

Figure 12:
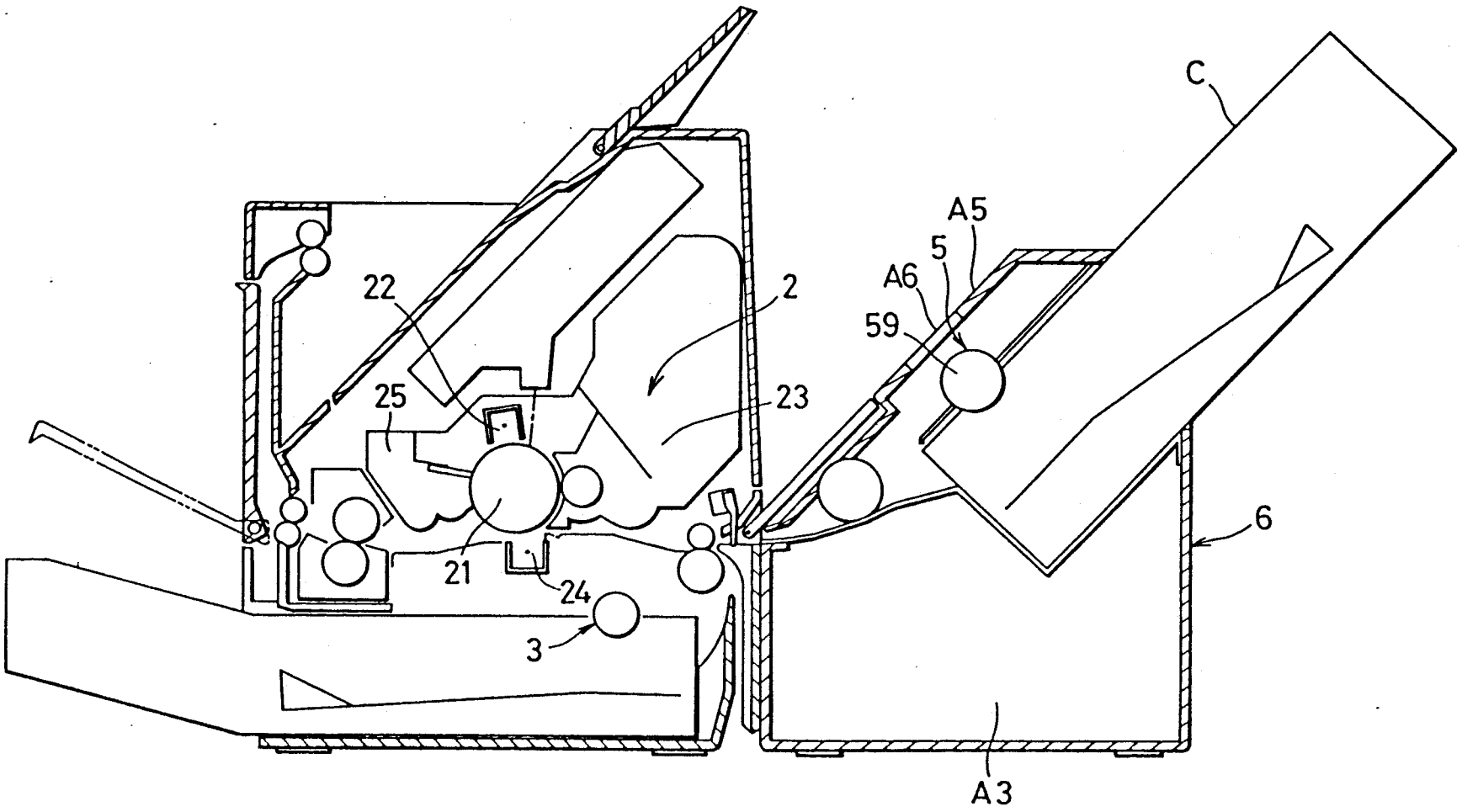
FIG. 12 is a schematic view of the inner arrangement of the paper feeding apparatus in FIG. 11 and an image forming apparatus to which the paper feeding apparatus in FIG. 11 is connected.

The paper delivery apparatus 5 is applied to a paper feeding apparatus 6 connected to a laser beam printer (See FIG. 12). The paper feeding apparatus 6 is disposed facing a window A6 of a support plate A5 between the lateral plates A3, A4 of the paper delivery apparatus 5 (See FIG. 11).

Figure 10:
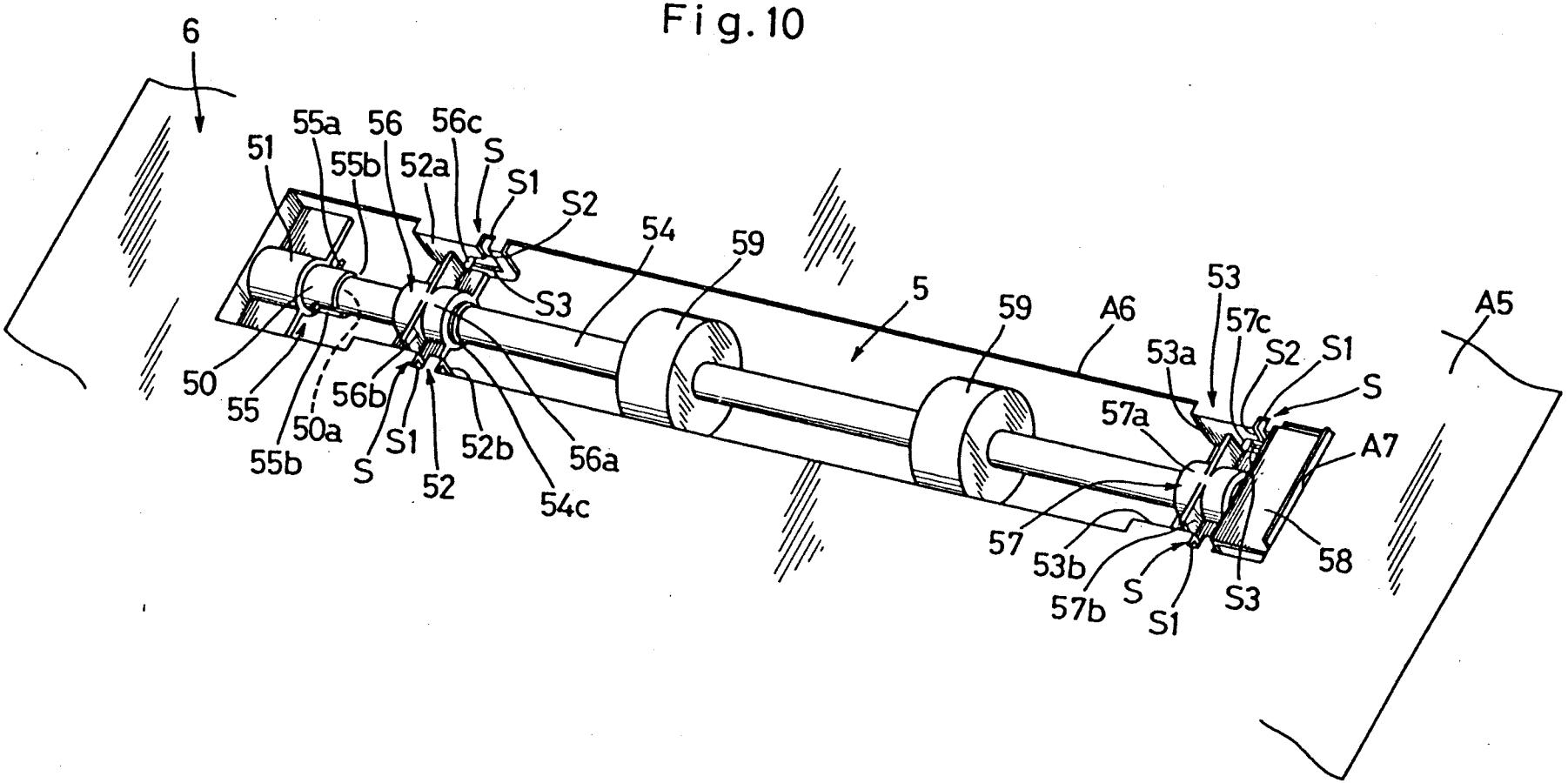
FIG. 10 is a perspective view of main portions of the paper delivery apparatus in accordance with a third embodiment of the present invention.
Figure 11:
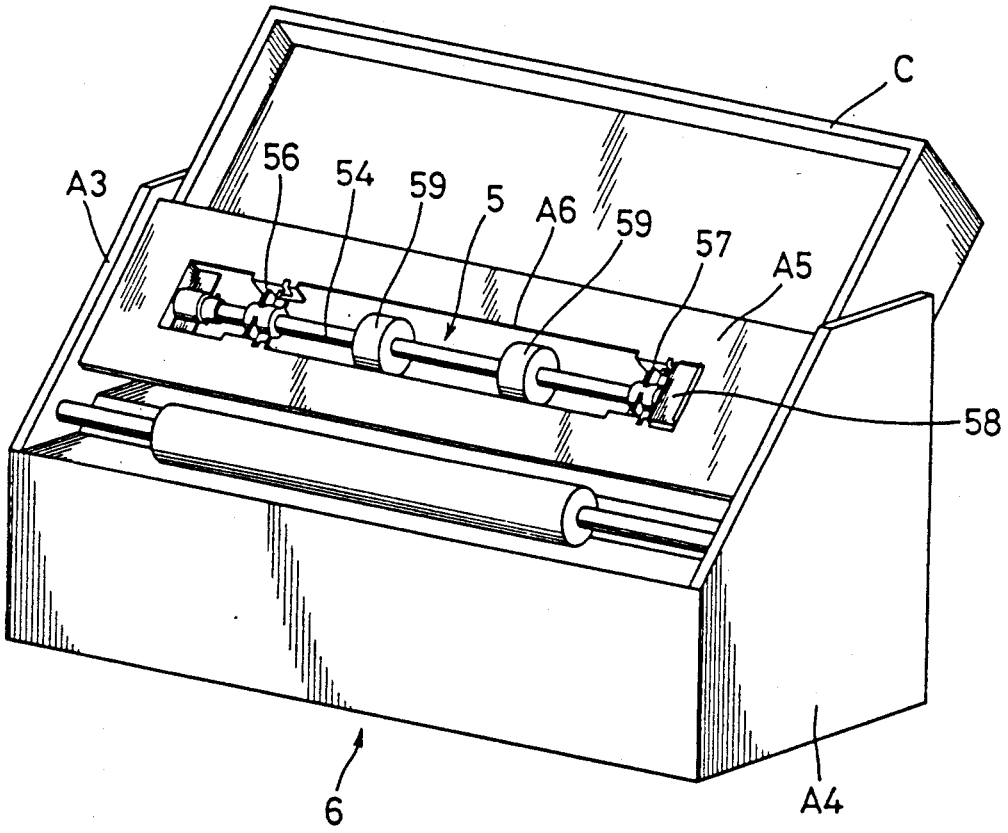
FIG. 11 is a perspective view of a paper feeding apparatus incorporating the paper delivery apparatus in FIG. 10.

As shown in detail in FIG. 10, a drive shaft 50 in the paper delivery apparatus 5 is disposed on one side of the support plate A5. The drive shaft 50 is rotatably supported by a bearing 51 supported by the support plate A5. The drive shaft 50 is provided at the tip thereof with a hollow portion 50*a* into which a roller support shaft 54, to be discussed later, is inserted with sufficient radial clearance provided therebetween. The other end of the drive shaft 50 passes through the lateral plate A3 and projects outside of the paper feeding apparatus 6. A driving gear (not shown) is attached to this projecting portion. The driving gear is connected to the drive system of the paper feeding apparatus 6.

The window A6 in the support plate A5 is provided at the edge thereof with a first bearing support member 52 and a second bearing support member 53. The first bearing support member 52 includes opposite support pieces 52*a*, 52*b* on the sides of the drive shaft 50. The second bearing support member 53 includes opposite support pieces 53*a*, 53*b* on the side of the lateral plate A4. The support pieces 52*a*, 52*b*, 53*a*, 53*b* slightly project from one edge of the window A6 toward the other edge thereof. The tips of these support pieces are bent toward the inside of the paper feeding apparatus 6 at right angles to the support plate A5. Each of the support pieces 52*a*, 52*b*, 53*a*, 53*b* has a slit unit S. The slit unit S includes a first slit S1 parallel to the support plate A5, a second slit S2 which communicates with the first slit S1 and which is formed at the bent portion of each of the support pieces 52*a*, 52*b*, 53*a*, 53*b*, and a third slit S3 communicating with the second slit S2 and extended toward the drive shaft 50. By the slits units S, pins 56*c*, 57*c* of bearings 56, 57, to be discussed later, may be introduced from the surface side of the support plate A5 and moved toward the drive shaft 50.

Figures 13, 14:
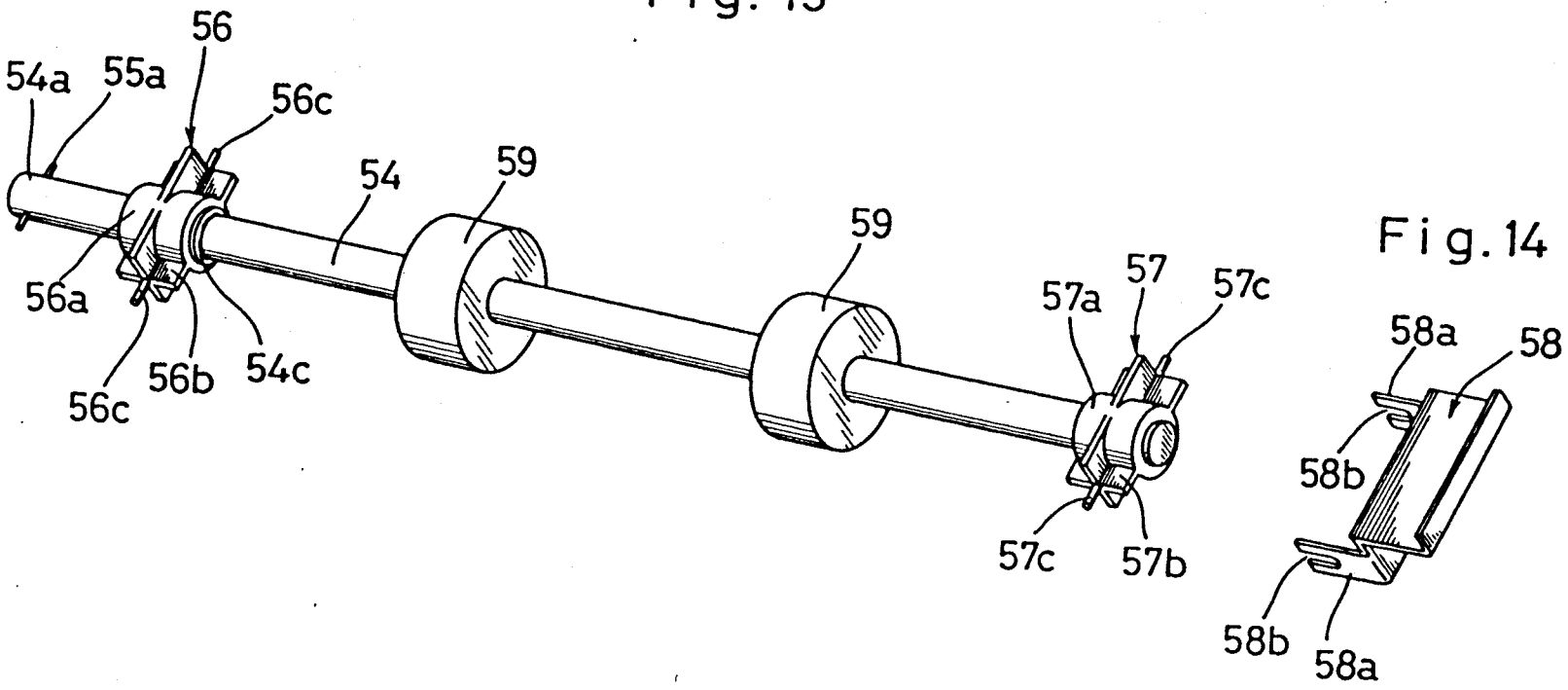
FIG. 13 is a perspective view of a roller support shaft 32.
FIG. 14 is a perspective view of a biasing member.

The roller support shaft 54 is integrally rotatably engaged with the drive shaft 50 through an engagement portion 55. The engagement portion 55 includes (i) an engagement pin 55*a* passing through one end 54*a* of the roller support shaft 54 (See FIG. 13) and (ii) engagement grooves 55*b* which are formed in the tip of the drive shaft 50 and into which the engagement pin 55*a* is introduced. Rubber rollers 59 are fitted on the roller support shaft 54 at the intermediate portion thereof. The bearings 56, 57 are also fitted on the roller support shaft 54 at both ends thereof, respectively. As shown in FIG. 13, the bearings 56, 57 include: main bodies 56*a*, 57*a* into which the roller support shaft 54 is inserted; stays 56*b*, 57*b* each having a cruciform section which projects radially from the main bodies 56*a*, 57*a*; and pins 56*c*, 57*c* projecting from the ends of the stays 56*b*, 57*b*. Fitted on the roller support shaft 54 are snap rings 54*c* which prevent the bearings 56, 57 from being axially moved.

The roller support shaft 54 is biased toward the drive shaft 50 by a biasing member 58, serving as an engagement maintaining member, which is fitted in the window A6 in the support plate A5. This maintains the roller support shaft 54 engaged with the drive shaft 50 by the engagement portion 55.

As shown in FIG. 14, the biasing member 58 is formed by bending a thin metallic sheet. The biasing member 58 has a pair of projecting pieces 58*a* for holding the support pieces 53*a*, 53*b*. Each of the projecting pieces 58*a* has a slit 58*b* into which the pin 57*c* of the bearing 57, passed through the slit unit S, may be inserted. The biasing member 58 is disposed, as resiliently deformed, between the pin 57*c* and the edge A7 of the window A6 of the support plate A5 (See FIG. 10). A paper feed cassette is generally designated by C.

The following description will discuss how to attach the roller support shaft 54.

First, the pins 56*c*, 57*c* of the bearings 56, 57 are inserted into the first slits S1 and the second slits S2 in the bearing support members 52, 53, while the roller support shaft 54 is inserted in the window A6. The roller support shaft 54 is moved along the third slits S3 and the engagement pin 55*a* of the roller support shaft 54 is engaged with the engagement grooves 55*b* on the side of the drive shaft 50. Then, the biasing member 58 is fitted in the window A6, and the pin 57c of the bearing 57 is put in the slits 58b in the projecting pieces 58a. This prevents the roller support shaft 54 from being moved toward the lateral plate A4.

Thus, in the paper delivery apparatus 5 too, the roller support shaft 54 may be readily attached to the support plate A5 without use of tools. If the rollers 59 are worn away and need to be replaced, the roller support shaft 54 may be readily removed from the support plate A5 by reversing the procedure above-mentioned.

Figure 15:
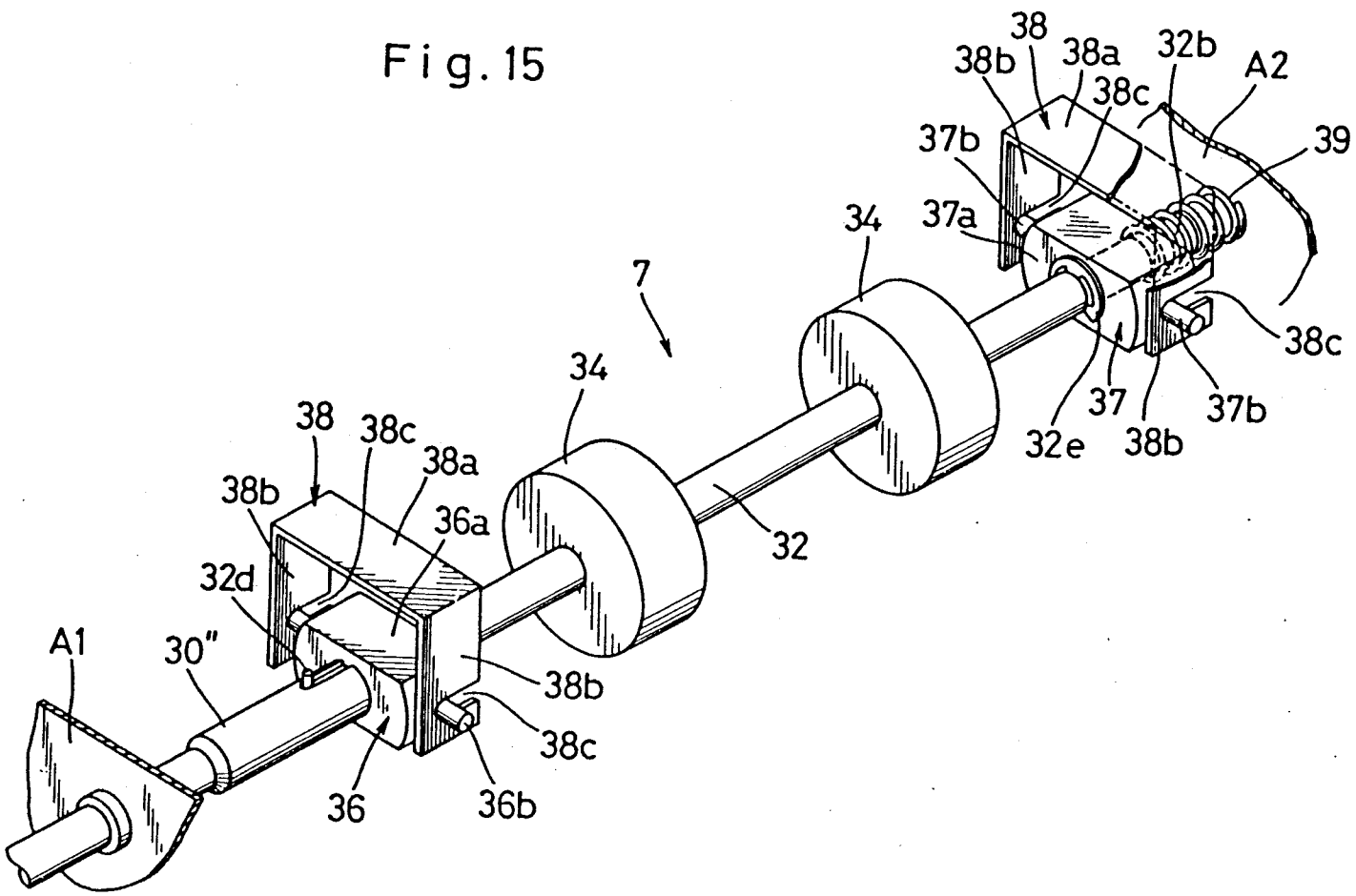
FIG. 15 is a perspective view of the paper delivery apparatus in accordance with a fourth embodiment of the present invention.

The paper delivery apparatus 3 formed inside of the laser beam printer shown in FIG. 1, may also employ such a biasing means to prevent the roller support shaft from being axially moved. FIG. 15 shows a paper delivery apparatus 7 arranged in such a manner. In FIG. 15, like parts are designated by like numerals used in FIG. 1.

The paper delivery apparatus 7 is different from the paper delivery apparatus 3 shown in FIG. 1, in the following points.

In FIG. 15, a drive shaft 30'' and a roller support shaft 32 are connected to each other without use of the joint 31, the slits 38c in bearing support members 38 are reversely opened in the direction toward the lateral plate A2, and a coil spring 39, as a biasing member, is fitted over one end 32b of the roller support shaft 32. The coil spring 39 is disposed, as compressed, between the lateral plate A2 and a bearing 36.

According to the paper delivery apparatus 7, the roller support shaft 32 may be readily removed from the bearing support members 38 in a simple manner as set forth below.

That is, the roller support shaft 32 is moved toward the lateral plate A2 against the spring load of the coil spring 39. This causes the pins 36b, 37b of the bearings 36, 37 to be disengaged from the slits 38c in the bearing support members 38. Then, the roller support shaft 32 is moved downward.

The roller support shaft 32 may be readily attached to the bearing support members 38 by reversing the procedure above-mentioned.

In the embodiment shown in FIG. 15, the biasing member is used as the engagement maintaining member for maintaining the roller support shaft 32 engaged with the drive shaft 30. However, other members than this biasing member may also be used. For example, there may be used, as the engagement maintaining member, a joint similar to the joint 31 in FIG. 1 and the snap pin 33 attached to the drive shaft 30. In this case, the joint may be formed integrally with the roller support shaft 32. This enables the snap pin 33 to prevent the roller support shaft 32 from being axially moved. Thus, the engagement of the roller support shaft 32 with the drive shaft 30 may be maintained.

In the foregoing, the description has been made of the paper delivery apparatus in which paper sheets housed in the paper feed cassette are taken one by one. However, the present invention is not limited to such a paper delivery apparatus. For example, the present invention may be applied to a paper conveying apparatus for conveying paper taken out from the paper feed cassette to the photoreceptor drum, or a paper discharging apparatus for discharging the paper for which printing has been complete.

In the embodiments above-mentioned, the drive shaft is introduced between the lateral plates after having passed through one lateral plate. However, the drive shaft may be disposed, in its entirety, between the lateral plates. That is, it is enough if at least tip of the drive shaft is disposed between a pair of lateral plates.

As thus described, according to the paper delivery apparatus using a roller of the present invention, the attachment and removal of the roller support shaft may be readily made without use of tools even in a limited space. Further, the roller support shaft may be supported by the bearing support members at a predetermined position. It is therefore not required to connect, with high precision, the drive shaft to the roller support shaft. This facilitates the connection of the drive shaft to the roller support shaft at the time of the attachment of the roller support shaft.

What is claimed is:

1. A paper delivery apparatus using a roller, said apparatus comprising:

a drive shaft having a tip end adapted to be disposed between a pair of lateral plates;

a roller support shaft having a roller directly attached thereto;

bearings fitted on said roller support shaft at both ends thereof;

bearings support members for axially movably supporting said bearings such that said bearings are freely removable therefrom when moved toward said drive shaft. and a joint axially movably attached to said drive shaft, said joint being adapted to engage with said roller support shaft and to prevent said bearings from coming off from said bearing support members when said joint is moved toward said roller support shaft.

2. A paper delivery apparatus according to claim 1, wherein said bearings cooperate with said roller support shaft to prevent said bearings from being axially moved on said roller support shaft, and said roller support shaft is movable toward said drive shaft by a predetermined distance such that said bearings may be removed from said bearing support members.

3. A paper delivery apparatus according to claim 2, wherein said joint includes means for preventing said roller support shaft from being axially moved, thereby to prevent said bearings from coming off said bearing support members.

4. A paper delivery apparatus according to claim 2, wherein said joint includes means for coming into contact with one of said bearings, thereby to prevent said bearings from coming off said bearing support members.

5. A paper delivery apparatus according to claim 1, wherein the bearing on the drive shaft side is axially movably fitted to said roller support shaft, and said joint includes means for coming into contact with said last-named bearing to prevent said last-named bearing from coming off the bearing support member supporting said last-named bearing.

6. A paper delivery apparatus using a roller, said apparatus comprising:

a drive shaft having a tip end adapted to be disposed between a pair of lateral plates;

a roller support shaft having a roller directly attached thereto and adapted to be disposed in series to said drive shaft;

bearings fitted on said roller support shaft at both ends thereof;

bearing support members for axially movably supporting said bearings such that said bearings are freely removable therefrom when said bearings have been axially moved in a direction away from said drive shaft;

an engagement portion for integrally rotatably engaging said roller support shaft and said drive shaft when said roller support shaft together with said bearings is axially moved toward said drive shaft; and an engagement maintaining member for maintaining the integral engagement of said drive shaft with said roller support shaft.

7. A paper delivery apparatus according to claim 6, wherein said bearings cooperate with said roller support shaft to prevent said bearings from being axially moved on said roller support shaft, and said bearing support members permit said bearings to be removed therefrom by moving said bearings in a radial direction of said roller support shaft after said bearings have been moved in an axial direction of said roller support shaft away from the drive shaft.

8. A paper delivery apparatus according to claim 6, wherein said engagement portion includes axially extending engagement grooves and an engagement pin adapted to be introduced into said engagement grooves.

9. A paper delivery apparatus using a roller, said apparatus comprising:

a drive shaft having a tip end adapted to be disposed between a pair of lateral plates;

a roller support shaft having a roller attached thereto;

bearings rotatably fitted on said roller support shaft at both ends thereof and axially fixed thereon;

bearing support members for supporting said bearings such that said bearings are axially movable toward said drive shaft by a predetermined distance to remove said bearings from said bearing support members; and a joint member axially movably attached to said drive shaft, said joint member being adapted to engage with said roller support shaft and to contact one of said bearings, thereby to prevent said bearings from coming off from said bearing support members when said joint member is moved toward said roller support shaft.

10. A paper delivery apparatus using a roller, said apparatus comprising:

a drive shaft having a tip end adapted to be disposed between a pair of lateral plates;

a roller support shaft having a roller attached thereto and adapted to be disposed in series to said drive shaft, with one end of said roller support shaft adjacent said tip end of said drive shaft;

bearings fitted on said roller support shaft at both ends thereof;

bearing support members for axially movably supporting said bearings such that said bearings are removable therefrom when moved toward said drive shaft, at least the bearing on said one end of said roller support shaft being axially movably fitted on said roller support shaft; and a joint member axially movably attached to said drive shaft, said joint member being adapted to engage with said roller support shaft and to contact said at least one axially movably fitted bearing to prevent said bearings from coming off from said bearing support members when said joint member is moved toward said roller support shaft.

11. A paper delivery apparatus for a paper utilizing device, said apparatus comprising:

first and second bearing support members adapted for attachment to a paper utilizing device;

a roller support shaft having a roller supported thereon;

first and second bearing members rotatably fitted on said roller support shaft adjacent first and second ends thereof, respectively, and supported by said first and second bearing support members, respectively, said first bearing member and said first bearing support member including cooperating portions inhibiting said first bearing member from moving axially relative to said first bearing support member in a first direction toward said roller support shaft second end while permitting said first bearing member to move axially relative to said first bearing support member in the opposite direction, said second bearing member and said second bearing support member including cooperating portions inhibiting said second bearing member from moving axially relative to said second bearing support member in said first direction while permitting said second bearing member to move axially relative to said second bearing support member in said opposite direction;

a drive shaft having first and second ends and adapted to be disposed on the paper utilizing device with said drive shaft first end adjacent said roller support shaft first end and with said drive shaft second end adapted to driving by a drive source; and a joint member engaging said drive shaft and movable between a first position, in which said joint member drivingly couples said drive shaft to said roller support shaft and inhibits said first bearing member from moving axially in said opposite direction, and a second position, in which said drive shaft is decoupled from said roller support shaft and said first bearing member is free to move axially in said opposite direction, whereby, with said first and second bearing support members attached to a paper utilizing device, said drive shaft disposed on the paper utilizing device, and said joint member in the first position, said roller support shaft is rotatably mounted on the paper utilizing device and is drivable by said drive shaft, and said joint member can be moved to the second position, permitting said first bearing member to move axially in said opposite direction and freeing said roller support shaft for removal of said roller support shaft and roller from the paper utilizing device.

12. A paper delivery apparatus according to claim 11, further comprising means for preventing said bearing members from being axially moved on said roller support shaft, and wherein with said joint member in the second position said roller support shaft is movable in said opposite direction toward said drive shaft by a predetermined distance, permitting said bearing members to be removed from said bearing support members.

13. A paper delivery apparatus according to claim 11, wherein said joint member includes means operating when said joint member is in the first position for preventing said roller support shaft from being axially moved relative to said drive shaft, thereby preventing said bearing member from coming off said bearing support members.

14. A paper delivery apparatus according to claim 11, wherein with said joint member in the first position, said joint member contacts said first bearing member, thereby preventing said first bearing member from coming off said first bearing support member.

15. A paper delivery apparatus according to claim 11, wherein said first bearing member is axially movably supported on said roller support shaft, and said joint member contacts said first bearing member to prevent said first bearing member from coming off said first bearing support member.

16. A paper delivery apparatus for a paper utilizing device, said apparatus comprising:

a roller support shaft having a roller supported thereon;

first and second bearing members rotatably fitted on said roller support shaft, adjacent first and second ends thereof, respectively, for axial movement therewith;

a drive shaft having first and second ends and adapted to be disposed on a paper utilizing device with said drive shaft first end adapted for driving by a drive source;

first and second bearing support members adapted for attachment to a paper utilizing device and cooperating with said first and second bearing members, respectively, to support said roller support shaft and roller on the paper utilizing device with said roller support shaft and bearing members axially movable relative to said bearing support members between an operating position, in which said roller support shaft is retained on the paper utilizing device with said drive shaft second end engaging said roller support shaft first end to permit driving of said roller support shaft, and a removal position, in which said roller support shaft can be removed from the paper utilizing device; and an engagement maintaining member for maintaining said roller support shaft in the operating position with said drive shaft second end engaging said roller support shaft first end.

17. A paper delivery apparatus according to claim 16, further comprising means for preventing said bearing members from being axially moved on said roller support shaft, and wherein said bearing support members include means permitting said bearings to be removed therefrom by moving said roller support shaft and bearing members in a radial direction of said roller support shaft when said roller support shaft is in the removal position.

18. A paper delivery apparatus according to claim 16, wherein said drive shaft second end includes axially extending engagement grooves therein, and said roller support shaft first end includes an engagement pin adapted to be introduced in said engagement grooves for driving of said roller support shaft by said drive shaft.

19. A paper delivery apparatus for a paper utilizing device, said apparatus comprising:

first and second bearing support members adapted for attachment to a paper utilizing device;

a roller support shaft having a roller supported thereon;

first and second bearing members rotatably fitted on said roller support shaft adjacent first and second ends thereof, respectively, and supported by said first and second bearing support members, respectively, said first bearing member and said first bearing support member including cooperating portions inhibiting said first bearing member from moving axially relative to said first bearing support member in a first direction toward said roller support shaft first end while permitting said first bearing member to move axially relative to said first bearing support member in the opposite direction, said second bearing member and said second bearing support member including cooperating portions inhibiting said second bearing member from moving axially relative to said second bearing support member in said first direction while permitting said second bearing member to move axially relative to said second bearing support member in said opposite direction;

a drive shaft having first and second ends and adapted to be disposed on the paper utilizing device with said drive shaft first end adjacent said roller support shaft first end and with said drive shaft second end adapted for driving by a drive source; and biasing means for biasing said roller support shaft in the first direction to bring said roller support shaft first end into engagement with said drive shaft first end to permit driving of said roller support shaft and said roller, while permitting said roller support shaft to be moved in the second direction to remove said bearing members from said bearing support members and allow removal of said roller support shaft and roller from the paper utilizing device.

* * * * *